US005640916A

United States Patent [19]

Kaetterhenry et al.

[11] Patent Number: 5,640,916

[45] Date of Patent: Jun. 24, 1997

[54] QUILTING METHOD AND APPARATUS

[75] Inventors: Jeff Kaetterhenry, Davie; Glenn E. Leavis, Hollywood; James T. Frazer, Coral Springs; David B. Scott, Parkland; Andrew K. Schnaufer, Coral Springs, all of Fla.

[73] Assignee: L&P Property Management Company, Chicago, Ill.

[21] Appl. No.: 497,727

[22] Filed: Jun. 30, 1995

[51] Int. Cl.[6] ..... D05B 11/00; D05B 21/00

[52] U.S. Cl. ..... 112/118; 112/470.12; 112/470.36; 112/475.07; 112/475.08

[58] Field of Search ..... 112/117, 118, 112/119, 475.07, 475.08, 475.18, 475.19, 475.06, 102.5, 470.06, 470.07, 470.12, 470.13, 470.36

[56] References Cited

U.S. PATENT DOCUMENTS

| | | | |
|---|---|---|---|
| 2,119,341 | 5/1938 | Milner . | |
| 3,559,600 | 2/1971 | Kalning . | |
| 3,989,239 | 11/1976 | Scriven, Jr. et al. . | |
| 4,173,191 | 11/1979 | Taddicken . | |
| 4,353,539 | 10/1982 | Doyen et al. | 112/475.07 X |
| 4,493,276 | 1/1985 | Sadeh | 112/470.07 |
| 4,664,577 | 5/1987 | Bonali . | |
| 4,669,400 | 6/1987 | Michaels et al. . | |
| 5,018,463 | 5/1991 | Nakajima . | |
| 5,040,473 | 8/1991 | Zesch et al. | 112/470.12 X |
| 5,136,955 | 8/1992 | Resta et al. | 112/118 |
| 5,425,319 | 6/1995 | Resta et al. . | |

*Primary Examiner*—Peter Nerbun

*Attorney, Agent, or Firm*—Wood, Herron & Evans, L.L.P.

[57] ABSTRACT

The quilting of rectangular comforter bags, mattress cover panels or other similar panels is provided without the need to premount the panel on a rectangular frame. A leading edge clamp is preattached along the leading edge of a panel and the clamp is fed from an operator station to the upstream end of a shuttle movably mounted on the frame of a programmed single needle quilting machine. Opposed belt conveyors on opposite sides of the shuttle advance the clamp and pull the panel onto the shuttle, with the belts gripping the side edges of the panel as it is pulled. A trailing edge clamp bar frictionally engages the panel to provide trailing edge securement to the panel, with the belts and leading edge clamp providing securement around the other edges to stretch the panel on the shuttle. The shuttle reciprocates longitudinally under a sewing head that moves transversely on the frame at a quilting station, while the sewing head operates to stitch a pattern in the panel. A pickup head then engages the clamp and directs it along a conveyor across an outfeed table at the top of the frame, pulling the quilted panel over the table where the clamp is released to drop the panel on the table, where it is folded and conveyed to a stacker. When a first quilted panel is free of the shuttle, another front edge clamp similarly pulls another panel onto the shuttle. When a clamp has released a panel at the outfeed table, it is returned by the conveyor to the operator station for reuse.

22 Claims, 11 Drawing Sheets

QUILTING METHOD AND APPARATUS

The present invention relates the art of quilting and, more particularly, to the feeding and supporting of rectangular panels of multilayered fabric in an automated quilting machine for performance of the quilting process.

BACKGROUND OF THE INVENTION

In the manufacture of quilted comforters and of quilted multilayered fabric used for the outer coverings of mattresses, automated quilting machines that stitch patterns under the control of programmed computers or controllers are employed. The stitching of patterns onto such quilts is customarily carried out in one of two types of manufacturing processes.

In one type of process, the quilting is performed onto webs of multilayered fabric, usually with multineedle quilting machines, and arrays of patterns are sewn as the web is fed and shifted beneath a stationary array of needles. After the web is quilted, individual panels are cut from the web. Such a process is used in the manufacture of mattresses covers, particularly.

In another type of process, and the one to which the present invention most particularly relates, individual unquilted comforters and individual unquilted mattress covers are preformed into rectangular panels of several layers of fabric and sewn together, usually only around the edges. Such unquilted mattress cover panels and comforters, which are herein sometimes referred to as merely panels or comforter bags, are typically stretched onto rectangular racks or frames, usually made of wood or metal, which are fed into the quilting machines. The frames carrying the stretched panels are then caused to move in relation to a quilting head in accordance with a pattern control, which may be a mechanical template or programmed pattern controller or computer.

Movement of the panel relative to the quilting or sewing head is achieved by either x-y motion of the rack beneath a stationary sewing head, by x-y movement of the sewing head over a fixed rack or frame, or by reciprocation of the rack in the machine under a quilting head in a longitudinal direction while the head reciprocates across the machine frame in a transverse direction, stitching a pattern on the panel as the head and frame are being moved. The motion of the rack beneath the quilting or sewing head and the motion of the head across the machine provide planar x-y motions that are carried out under the control of a program control device so that a particular pattern is stitched onto the panel. Full panel-size patterns requiring 360° motion of the head relative to the frame can be stitched in this way.

Devices that employ such frames or racks to support and stretch the panels as they are fed into or through a quilting machine suffer the disadvantage of requiring labor intensive handling of the panels, both before and after quilting, to mount the unquilted panels on the frames for feeding into the machines and to remove the finished quilts from the frames after the quilting process is complete. With quilting machines being made increasingly faster, the loading and unloading of such quilts onto and off of such frames or racks becomes a major time consuming factor affecting the productivity of the entire quilting process, either by slowing the rate at which the panels can be quilted by the machines to less than the capacity of the machine or by requiring additional operators to handle the workpieces and finished products to keep up with the speed of the machine.

Attempts have been made to provide quilting machines that eliminate the separate rack or frame by providing the machine with built-in panel-supporting and stretching structure into which the panels can be directly loaded onto the machine and fed into a quilting station. The difficulty in providing such permanent supporting structure, which must include structure for gripping all four sides of the panels to stretch the panels therebetween, is in efficiently and effectively mounting and removing of the panels to and from the structure on the machine. The mounting and removing of the panels to and from such machines must be carried out in real time on the machine, which can slow down the machine and interfere with the machine throughput by the amount of time it takes to load and unload the panels.

Accordingly, a long standing need has existed in the single panel quilting art for an quilting apparatus and process that does not require separate panel supporting racks or frames and that can easily and reliably load and unload panels onto mounting and stretching structure on the quilting machine without material interruption or delay of the quilting operation of the machine.

SUMMARY OF THE INVENTION

One primary objective of the present invention is to provide the feeding of individual comforter bags and other such panels into a quilting machine without previously mounting the panels onto rectangular frames or racks.

Another objective of the present invention is to increase the productivity and throughput of an automated quilting machine, particularly of the single needle type.

It is a particular objective of the present invention to provide a method and apparatus by which individual rectangular panels or comforter bags are fed to quilting machines without the need for separate supporting frames while the panels are nonetheless secured around their edges to holding structure or securements on the quilting machine that support and stretch the panels as they are quilted.

It is still another objective of the present invention to provide a method and apparatus by which the infeeding of panels to be quilted and the outfeeding of quilted panels to and from a quilting machine are overlapped in time so as to optimize the use of the quilting machine equipment and the speed of the quilting operation.

In accordance with the principles of the present invention, there is provided a quilting machine having a movable shuttle mounted thereon to which individual panels to be quilted are separately mounted for sewing. The shuttle moves longitudinally relative to a quilting station while a quilting or sewing head moves transversely, with the movements being controlled by a programmed computer or controller, to stitch a pattern onto the panels as each is moved relative to a quilting station. The shuttle is provided with clamps, grippers or other securements along four edges of its rectangular perimeter to hold the edges of the panel and stretch the panel in a horizontal plane during a quilting operation so that the pattern can be stitched thereon.

In accordance with the preferred embodiment of the invention, the four securements on the shuttle include a pair of side securements in the form of elongated gripping elements extending longitudinally along both sides the shuttle to hold a panel along its side edges. The four securements also include a rear securement in the form of a trailing edge weight bar or friction clamp that extends transversely across upstream end of the shuttle to hold the trailing edge of a panel. In addition, a removable front edge or leading edge clamp is provided to engage the leading edge of the panel. The leading edge clamp includes a transverse clamping bar that is removably connectable at its ends to the sides of the shuttle.

Further in accordance with the preferred embodiment of the invention, the shuttle is provided with a feeding assembly that includes a pair of opposed belt conveyors that connect to and advance the clamp onto the shuttle, pulling onto the shuttle a panel that is gripped at its leading edge by the clamp. Preferably, the opposed belt conveyors also function as the gripping elements of the side securements that grip the sides of the panel so that transverse tension is maintained on the panel during stitching. When a panel has been fed onto the shuttle, the leading edge clamp provides front edge securement that cooperates with the trailing edge clamping bar to longitudinally tension the panel for quilting. With the panel so mounted and stretched on the shuttle, the shuttle is moved longitudinally through a quilting station while a sewing head at the quilting station is moved transversely of the shuttle, whereby, under the control of a programmed control system, a pattern is caused to be stitched onto the panel.

Preferably, the conveyor/grippers are set apart at an adjustable distance so that the shuttle can accommodate panels of differing widths. In addition, the conveyor/grippers are moveable apart, preferably with the same mechanism as provides for their adjustable spacing, so that a desired tension can be maintained on the panels.

With the preferred embodiment of the invention, after a panel has been quilted, the shuttle returns the shuttle to a transfer position, whereupon a pickup head of a clamp transfer mechanism engages the front end clamp and, with the quilted panel remaining engaged by the clamp, picks up the clamp and thereby the quilted panel and moves the clamp over an outfeed table at the top of the machine. As the clamp is picked up, the securements at the back and sides of the shuttle are released and the quilted panel is free to follow the clamp to the outfeed table. Once over the outfeed table, a clamp release mechanism over the outfeed table causes the clamp to release the quilted panel, which then drops onto the outfeed table. Preferably, the clamp makes a reciprocating motion over the table to cause the quilted panel to fold at least once before the clamp releases it to the table. After the panel is so placed on the outfeed table, the clamp transfer mechanism moves the clamp pickup head to an operator station at the front of the machine at which the pickup head is actuated to release the front edge clamp onto a clamp receiving platform at the operator station, from which the clamp can be reloaded with another panel and advanced onto the shuttle. The pickup head then returns to a standby position awaiting signals to activate the pickup of the next clamp at the transfer station.

In order to optimize the productivity of the machine, further in accordance with principles of the present invention there is provided more than one leading edge clamp. Thus, when the quilting of one panel is completed and the transfer mechanism has picked up from the shuttle the leading edge clamp that is engaging the quilted panel, a second clamp with a panel clamped thereto can be fed onto the shuttle. This second panel and second leading edge clamp are then carried on the shuttle through the quilting station in a quilting operation. Further, while a panel is being quilted, the previously quilted panel may be undergoing transfer to the outfeed area or station to be dropped on the outfeed table, and the next panel to be quilted may also be in the process of being readied at the operator station, by securing it to another leading edge clamp, and placing it for immediate feed onto the shuttle as soon as the shuttle is free.

Further in accordance with the present invention, there is provided a transfer mechanism by which a clamp pickup head is moveable to a transfer position that is adjacent, and preferably directly over, the shuttle's leading edge at the upstream end of the quilting station. From the transfer position, the mechanism further moves the pickup head to a quilt release position overlying the outfeed table at which the clamp is caused to release the quilt onto the outfeed table. Further, the head is moveable to a clamp return position adjacent the operator station where the pickup head releases the clamp to return it to the operator. The pickup and releasing actions are preferably provided by camming actuators at the respective stations that cooperate with the pickup head and clamps to cause the pickup and releasing to take place. In the preferred embodiment of the invention, a chain conveyor or other transfer mechanism transfers the pickup head along a path among the pickup, quilt release and clamp return positions.

With the present invention, a comforter bag or panel can be placed in ready condition secured by a leading edge clamp and positioned for feeding onto the shuttle before the previously quilted comforter is removed from the shuttle. Then, as soon as the previously quilted panel is released from and out of the way of the securements on the shuttle, either by being pulled by the advancing of a front edge clamp by the pickup head or by the trailing edge of the panel being released and dropped clear of the shuttle, the feed of the next panel onto the shuttle can be immediately begun. Further, the operator performed portions of the loading and unloading steps can be carried out while the machine is executing a quilting cycle, permitting the machine to be operated at full capacity. A single operator can readily keep up with the speed of the machine, doing all of the manual panel handling operations and initiating all of the machine control commands in the process. The loading and unloading of separate frames is completely eliminated. While the operator is tending to the loading of the machine, the unloading of quilts from the machine can be fully automatic, requiring no operator intervention.

These and other objectives and advantages of the present invention will be more readily apparent from the following detailed description of the drawings of the preferred embodiment of the invention, in which:

DETAILED DESCRIPTION OF THE DRAWINGS

Figure 1A:
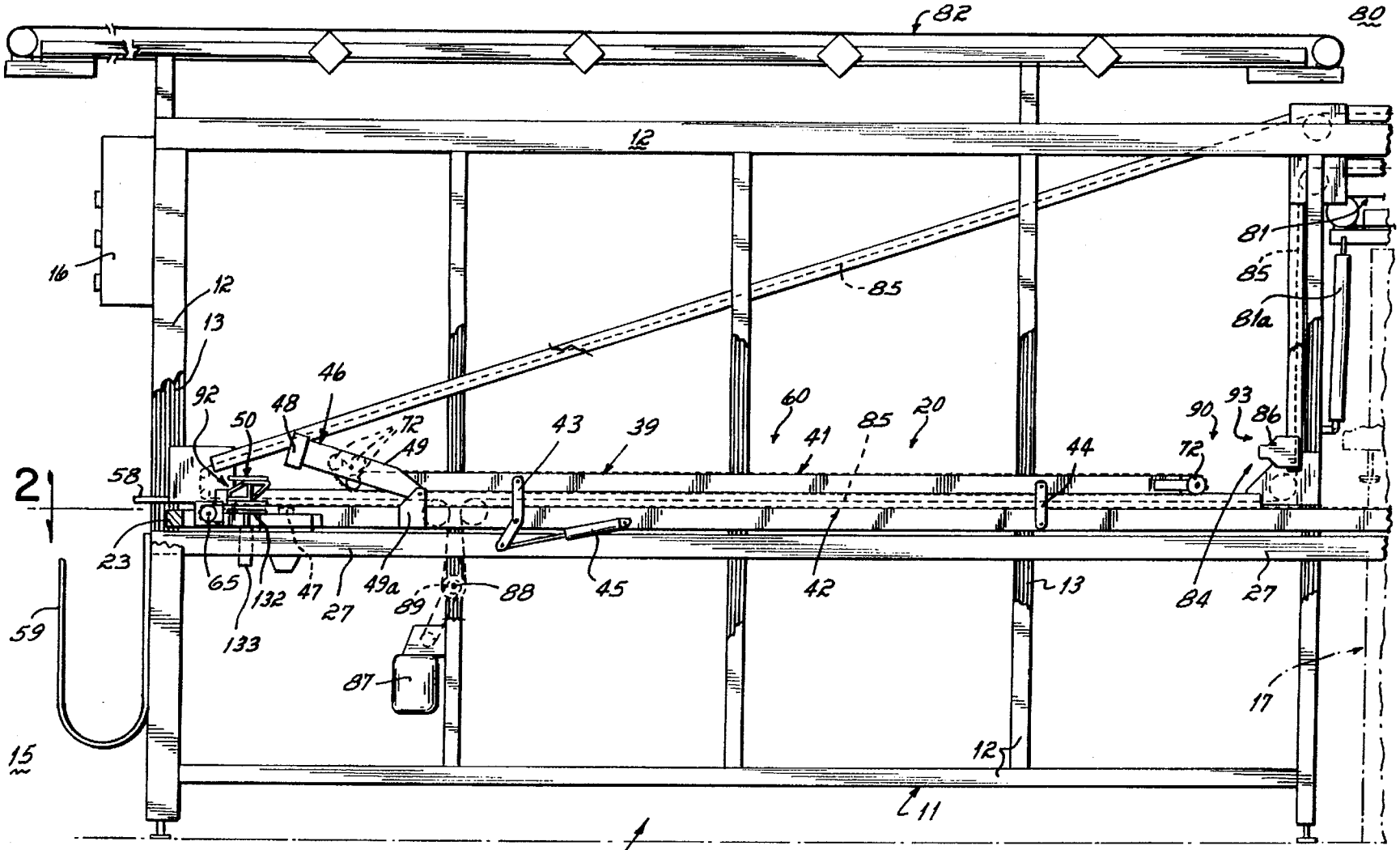
FIG. 1A is a side elevational view, partially broken away, of the front half of a quilting machine according to one embodiment of the present invention.
Figure 1B:
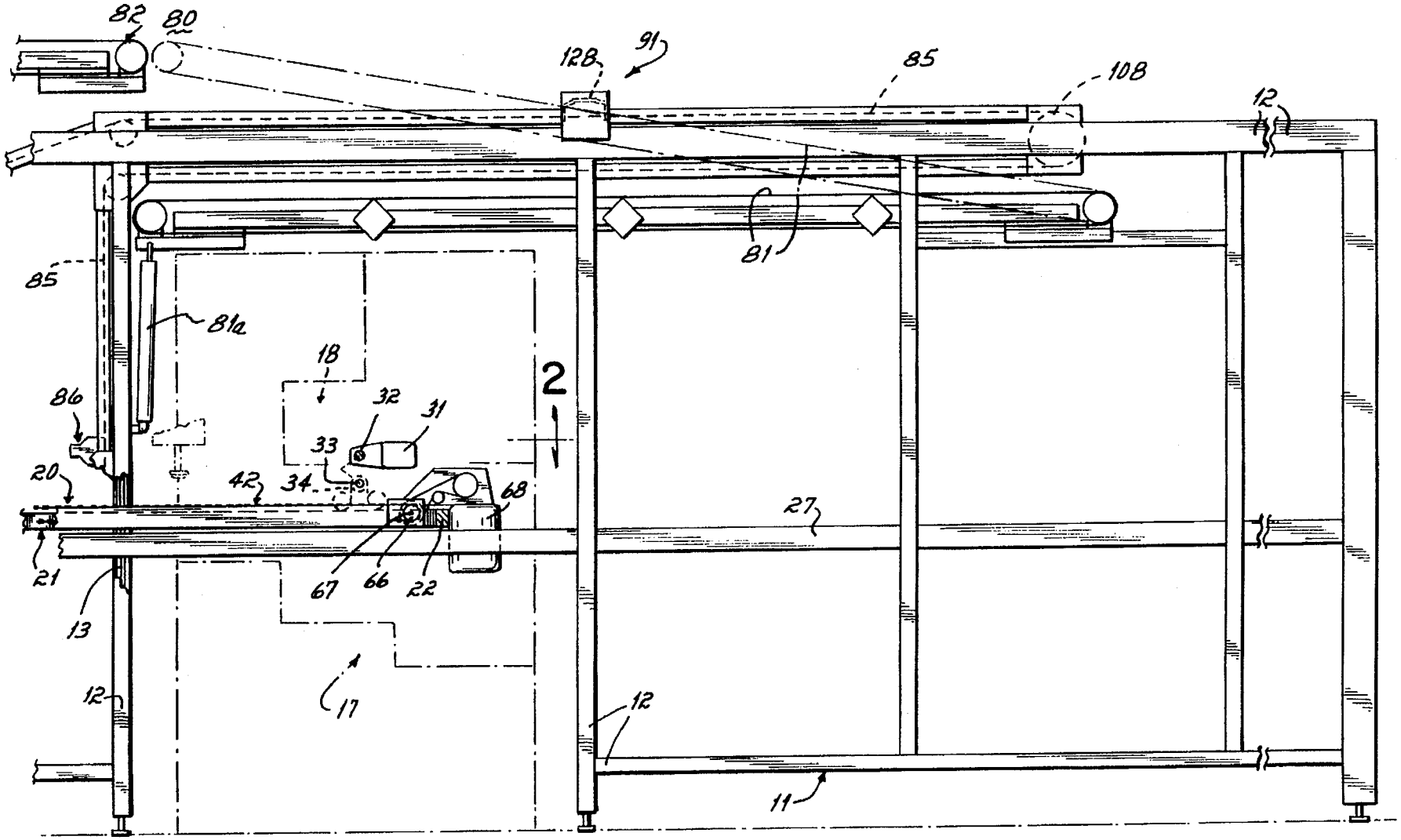
FIG. 1B is a side elevational view of the back half of the quilting machine of FIG. 1A.

Referring to FIGS. 1A and 1B, one embodiment of a quilting machine 10 according to the present invention is illustrated. The machine 10 includes a stationary frame 11 made up of right side frame members 12, which are broken away in FIG. 1A exposing left side frame members 13. An operator station 15 is located at the front of the frame 11. At the operator station 15, an operator prepares comforter bags for feeding into the machine 10 and operates the controls of the machine through a control panel 16. Intermediate the front and back of the frame 11 is situated a quilting station 17 at which a sewing head 18 operates to stitch upon a panel lying directly beneath. The sewing head 18 is part of a conventional single needle program controlled chain stitching sewing unit in which the head 18 is moveable transversely of the frame 11 under the control of a programmed controller that controls the transverse motion of the head 18 in synchronism with the control of longitudinal motion of the panel.

Figure 2:
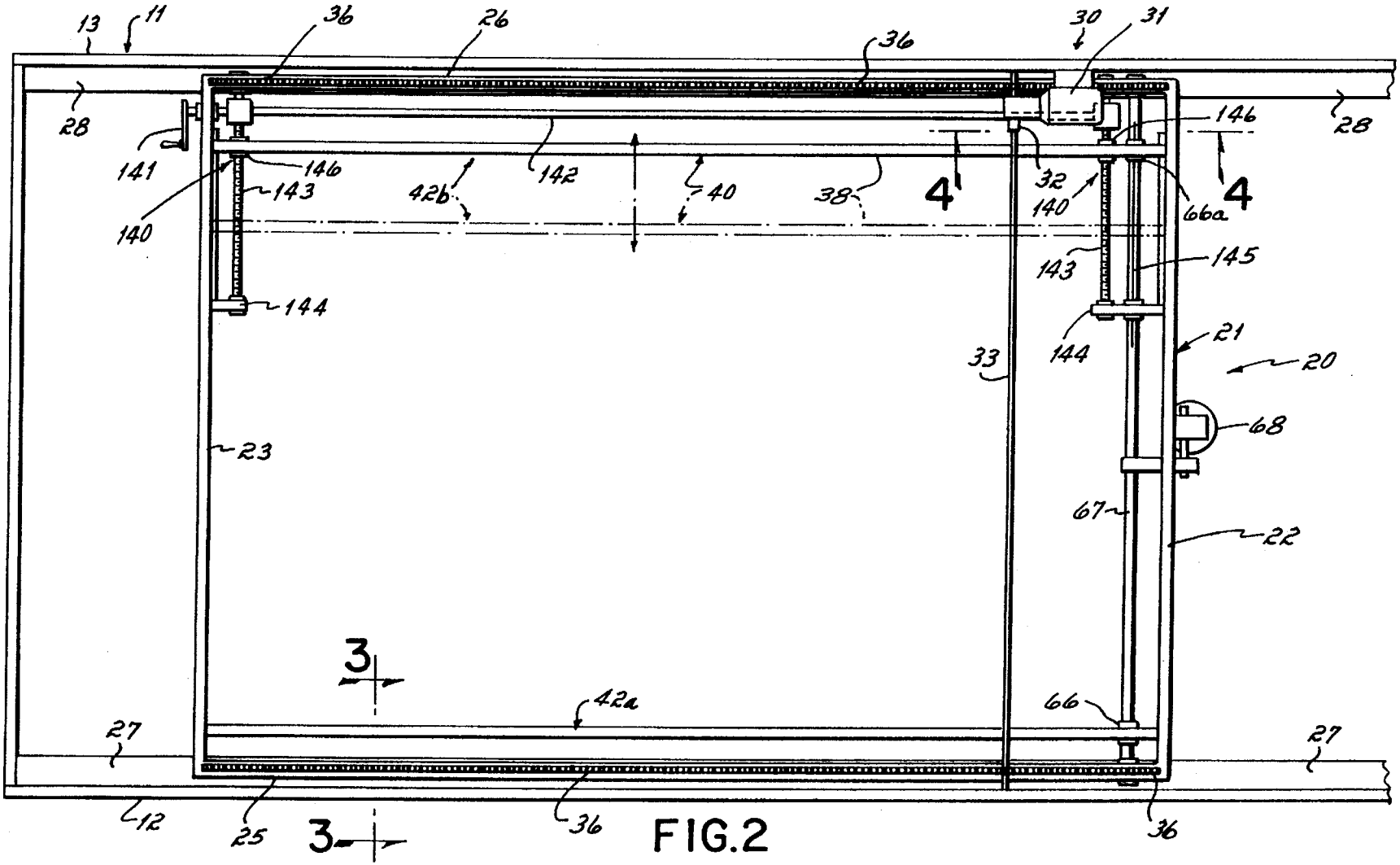
FIG. 2 is a cross-sectional view of the quilting machine of FIGS. 1 and 2 taken along the line 2—2 of FIGS. 1A and 1B.
Figure 3:
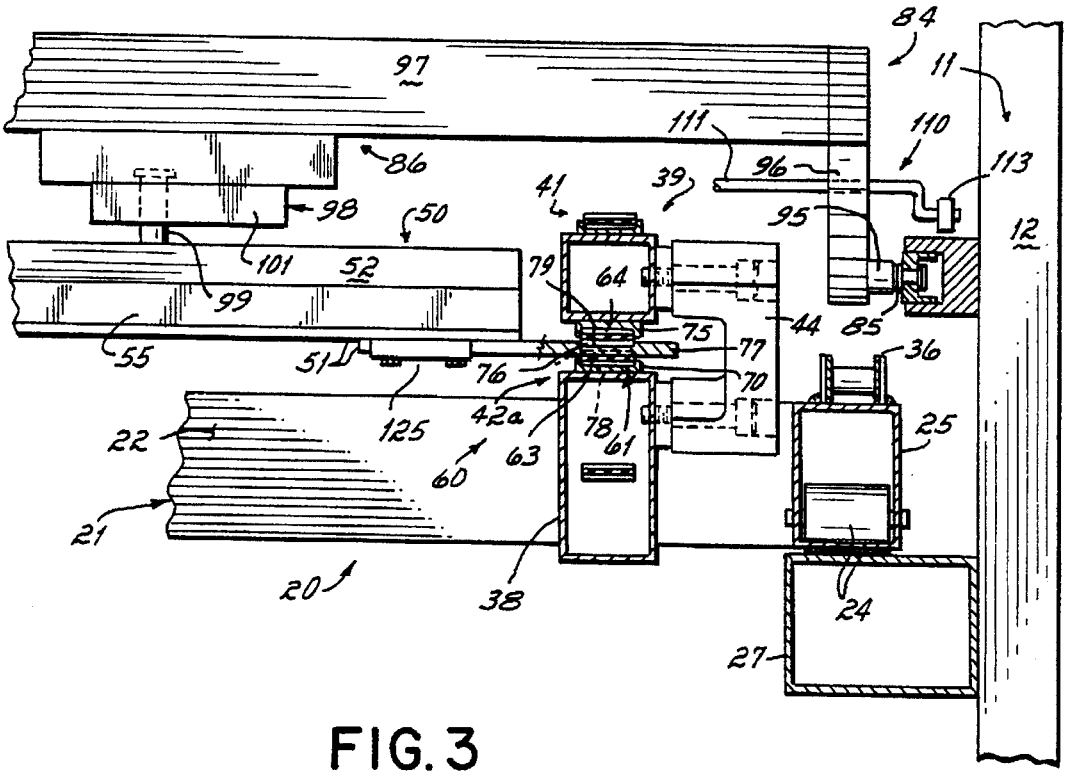
FIG. 3 is a cross-sectional view along the line 3—3 of FIG. 2.
Figure 4:
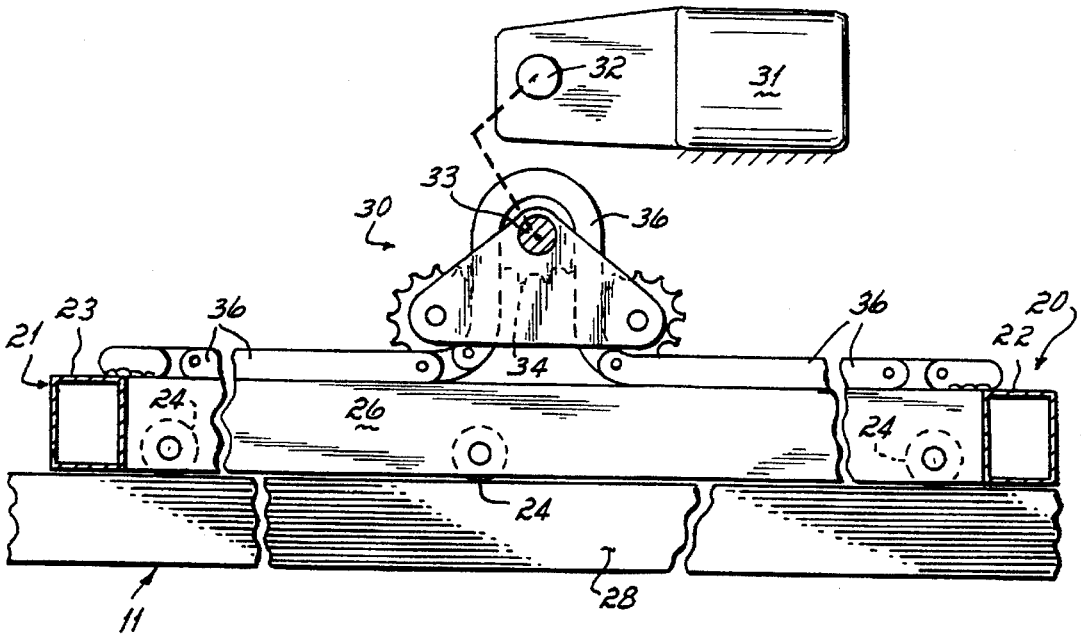
FIG. 4 is a view taken along line 4—4 of FIG. 2.

Longitudinal motion of the panel is provided by mounting the panel in a horizontal plane by stretching it upon a rectangular shuttle 20, illustrated generally in FIGS. 1A and 2. The shuttle 20 includes a rectangular metal rack or frame 21 formed of leading and trailing edge cross members 22 and 23, respectively, and right and left side members 25 and 26, respectively, which are rigidly connected at their ends to the ends of the cross members 22 and 23. The side members 25 and 26 are mounted on rollers 24 (FIG. 3) to reciprocate longitudinally on a pair of tracks or rails 27 and 28, respectively fixed to the sides 12 and 13 of the stationary machine frame 11. A shuttle drive 30 is provided to move the shuttle 20 longitudinally relative to the frame 11, as illustrated in FIGS. 2 and 4. The drive 30 includes a motor 31 mounted to the frame 11 and having an output shaft 32 drivably linked to a transverse shaft 33, rotatably mounted between the side members 12 and 13 of the frame 11 and having on the opposite ends thereof a pair drive sprockets 34. The sprockets 34 are each positioned to engage a rack formed of chains 36 fixed at its ends to extend longitudinally along the top surfaces of the shuttle side members 25 and 26.

In the prior art, a shuttle such as the shuttle 20 would support a rectangular wooden or metal rack or frame on which was stretched a panel to be quilted. Such a frame or rack would be mounted on such a shuttle with the panel prestretched thereon, and would be removed from the shuttle to a location at which the quilted panel would be removed from the frame or rack. Clips, clamps or other securement structure were provided around the four sides of the rack or frame to hold the panel thereon.

With the illustrated embodiment of the present invention, right and left side securements 39 and 40 are respectively provided, each including an upper side securement assembly 41 and a lower side securement assemblies 42. The lower side securement assemblies are fixed relative to the shuttle, mounted at their ends to the cross-members 22 and 23 to extend longitudinally on the shuttle 20. The right lower assembly **42*a* is fixed in a permanent position on the cross members 22 and 23 while the left lower assembly 42*b* is transversely adjustable on the cross members 22 and 23 to accommodate comforter bags or mattress cover panels of various widths. This adjustability is preferably a continuous adjustability provided by a screw adjustment mechanism 140, as illustrated in FIG. 2, or may be otherwise setable to discrete adjustment positions predetermined to accommodate standard comforter and mattress widths. With the screw adjustment mechanism 140, an operator adjustment crank or knob 141 on a shaft 142 journaled between cross-members 22 and 23 drives a pair of drive screws 143, 143 that extend between the left side member 26 and intermediate screw brackets 144 fixed to the front and rear cross-members 22 and 23, and is threaded through a nut 146 rotatably and axially secured to a fixed extrusion portion 38 of the lower securement assembly 42 of the left securement 40. When the mechanism 140 is adjusted, the entire left side securement 40 is carried by the screws 143 and moves toward or away from the right side securement assembly 39, thus varying the width of panel that will be supported on the shuttle 20**.

The upper assemblies 41 are each linked to the respective lower assemblies 42, each by respective front and back linking arms 43 and 44, which raise and lower the upper assemblies 41 from and onto the tops of the lower assemblies 42 to provide a clamping and releasing action on the edges of the panel. The clamping action and releasing action is achieved by pneumatic cylinders 45 connected between the front arms 43 and the lower assemblies 42. In FIG. 1A, the upper assemblies 41 are illustrated in the raised or released position. These side securements 39 and 40 provide the function of holding the side edges of a panel to the shuttle 20 and maintaining tension on the panel during the quilting operation.

A trailing edge securement assembly is provided on the shuttle 20 in the form of a transverse clamping bar or trailing edge clamp 46, illustrated in FIG. 1A. The trailing edge clamp 46 includes a anvil 47 fixed to and extending transversely of the shuttle 20, and an upper clamping bar 48 that is fixed to the ends of lever arms 49 pivotally mounted on brackets **49*a* to the sides of the lower side securement assemblies 42 near the trailing edge of the shuttle 20. The clamping bar 48 is raised by a pneumatic actuator (not shown) and by deactuation of the pneumatic actuator to descend under its own weight to bear upon the top of a panel extending over the anvil 47. The clamping bar 48 and anvil 47 exert a frictional force on a panel so held such that a longitudinal tension is established on the panel when the panel is pulled by its leading edge across the shuttle 20**.

Figure 5:
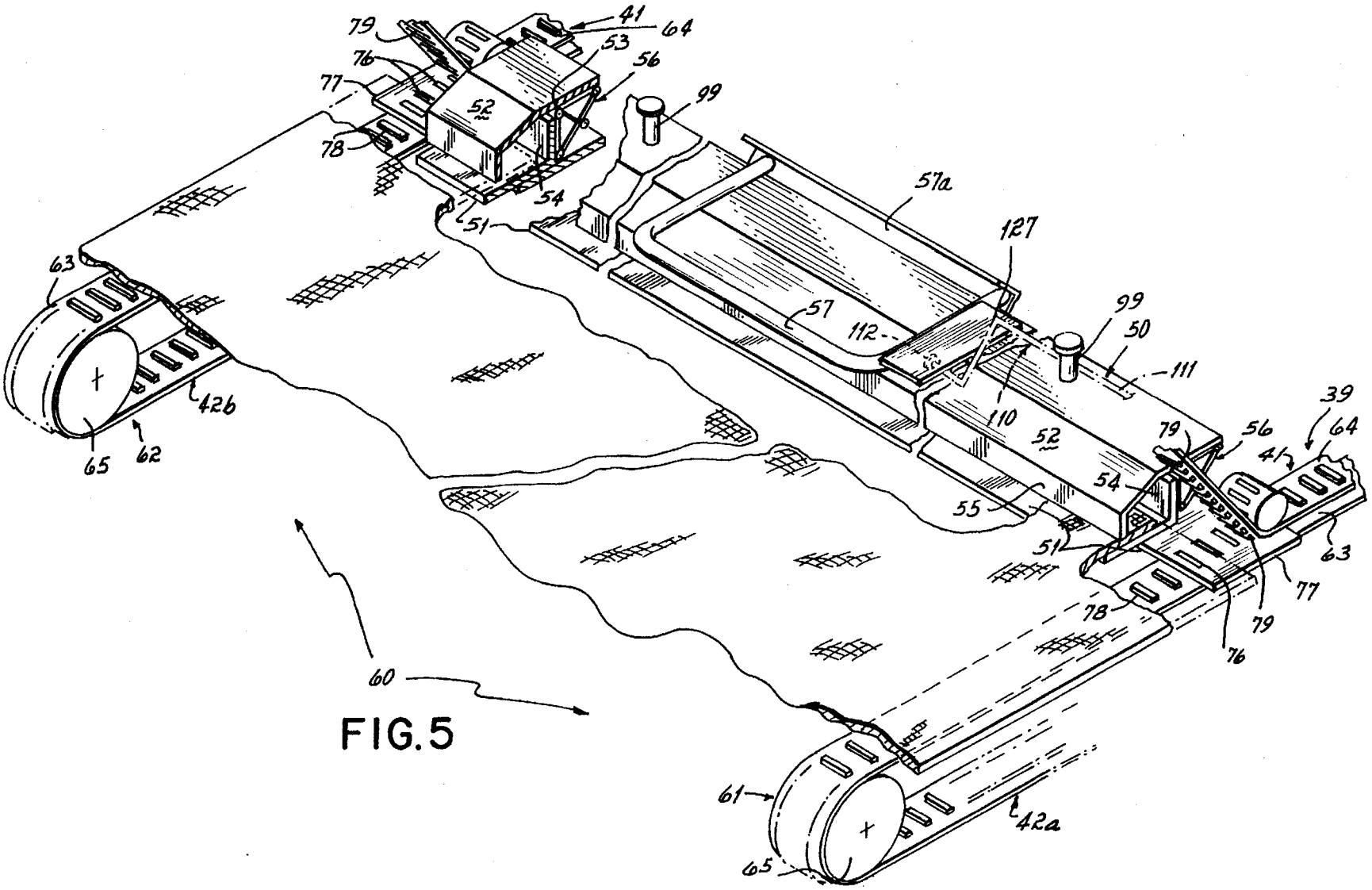
FIG. 5 is an isometric view, partially broken away, of the upstream end of a shuttle and a leading edge clamp of the portion of the machine illustrated in FIG. 1A.

A front securement assembly is provided in the form of a leading edge clamp 50, illustrated in FIG. 1A. The clamp 50 is loaded with the leading edge of a panel at the trailing edge of the shuttle 20 and transports this edge down stream toward the front of the machine 10. The clamp 50 is an assembly that is physically separate from the shuttle 20, as is more fully illustrated in FIGS. 3 and 5. Preferably, a plurality of such leading edge clamps 50 is provided, each made available to an operator at the front of the machine 10, each capable of being loaded, one at a time, onto the shuttle 20. Each clamp 50 includes a mounting and pressure plate 51 that is configured to extend, when the clamp 50 is loaded onto the shuttle 20, transversely across the shuttle with the opposite ends of the mounting plate 51 extended so as to set upon the lower side securement assemblies 42 of the right and left side securements 39 and 40. The clamp 50 includes a clamping head 52 that is pivotally connected about a transverse shaft 53 that is supported on an upstanding rear extension 54 of the plate 51, parallel to the plate 51. The clamping head 52 is provided with a downwardly extending clamping lip 55 at the free end thereof that is positioned to bear upon the leading edge of a panel that is set upon the pressure plate 51 to hold it thereto. The clamp 50 is also provided with an over center latching mechanism 56 that holds the head 52 with the lip 55 in a locked downward position, and a handle 57 by which the operator can close and lock the clamp 50. The handle 57 is fixed to a handle bracket 57*a*, which is pivotally mounted relative to the clamp head 52 and positioned to serve as a release of the over center latching mechanism 56, as is more fully illustrated in FIGS. 6B and 60, described below. A handle release plate 127 is provided, welded to the side of the handle 57, to provide for the automatic camming wheel actuation of the handle 57 to raise the head 52 and release the clamp 50. The plate 127 allows a camming wheel 112 mounted on a pivot shaft 111, shown in phantom in FIG. 6, of a camming lever mechanism 110 to release the clamp, which is explained more fully below.

In use, an operator at the operator station 15 at the front of the machine 10 (FIG. 1) places a panel in one of the clamps 50 located on a platform 132 of a return station 92 or, if the quilting machine 10 is manually operated, he places the clamp 50 on a platform 58 at the front of the frame 11 and places a panel to be quilted in a basket or trough 59 at the front of the frame 11. In either situation, the operator places the leading edge of the panel into the clamp 50 so placed and operates the handle 57 to close the clamp 50, securing the leading edge of the panel to the leading edge clamp 50. This operation can be carried out while the shuttle 20 is preoccupied and supporting a previously loaded panel for quilting at the quilting station 17. Then, when the shuttle 20 has been unloaded of the previously loaded panel and the shuttle has been returned empty to the front of the machine 10, as illustrated in FIG. 1A, the leading edge clamp 50 is loaded by the operator onto the shuttle 20 and advanced to the leading edge of the shuttle 20, pulling the panel that is held in the clamp 50 onto the shuttle 20 by an advancing drive assembly 60.

The advancing drive assembly 60 includes a pair of opposed belt conveyors, including a right conveyor 61 and a left conveyor 62, which also preferably form at least part of the two side securements 39 and 40. The belt conveyors 61 and 62 each include a lower drive belt 63, which preferably also forms at least part of the lower side securement assemblies 42, and an upper idler belt 64, which preferably also forms at least part of the upper side securements 41.

The lower belts 63 are timing type gear belts having legs on each side and mounted to the trailing edge of the frame 21 of the shuttle 20 on idler gear sprockets 65 (FIG. 1A) and to the leading edge of the frame 21 on drive gear sprockets 66 (FIG. 1B). As shown in FIG. 2, the drive gear sprockets 66 are fixed to the opposite ends of a transverse drive shaft 67 rotatably mounted across the leading end of the shuttle frame 21. The sprockets 65 and 66 are journaled to opposite ends of a lower extrusion 38 of the lower side securement assemblies 42 (FIG. 3). Because the transverse position of the left side securement 40 is adjustable by the mechanism 140 (FIG. 2), a splined end 145 is provided on shaft 67 to allow the sprocket 66 at the leading end of the left side securement 40 to slide on the shaft 67. A drive motor 68 is provided on the shuttle frame 21 to drive the belts 63 in response to signals from the machine controller. Throughout the length of the upper flight of the belts 63, the belts are supported on a channel 70, as illustrated in FIG. 3. The upper flights of the belts 63 serve as lower gripper surfaces of the lower side securement assemblies 42 of the right and left side securements 39 and 40.

The upper belts 64 may also be timing type gear belts and mounted at the trailing and leading edges of the frame 21 of the shuttle 20 to the upper side securement assemblies 41 on idler sprockets 72 (FIG. 1A) supported on opposite ends of an upper securement extrusion 37 (FIG. 3). The upper belts 64 are preferably also provided with additional idler sprockets at the upstream end of the shuttle 20 to flare the belts 64 upwardly to form a widened mouth into which the leading edge clamp 50 and panel can be more easily fed. Throughout the length of the lower flight of the belts 64, the belts are supported on a downwardly facing channel 75, as illustrated in FIG. 3. The lower flights of the belts 64 serve as upper gripper surfaces of the upper side securement assemblies 41 of the right and left side securements 39 and 40.

The leading edge clamps 50 are provided with a plurality of spaced notches 76 on the top and bottom surfaces of the plate 51 at each of the ends or on extensions 77 thereof. The notches on the bottom surfaces are configured to drivably engage similarly shaped and spaced lugs 78 on the outer surfaces of the lower belts 63. The lugs 78 and notches 76 form a driving engagement between the belts 63 and the clamp 50 so that, when the motor 68 is actuated, the clamp 50 moves with the belts 63 longitudinally on the shuttle 20. With the upper side securement assemblies 41 in their clamped positions, the upper belts 64 hold the clamp 50 in non-slipping engagement with the belts 63 by trapping or locking the lugs 78 in the notches 76 on the bottom of the plate 51 or plate extensions 77. Similar lugs 79 are also provided on the upper belt 64 to engage the notches 76 on the upper surface of the plate 51 or extension 77 thereof so that the upper belts 64 are driven with the clamp 50 and move in synchronism with the lower belts 63.

The clamps 50 are preferably provided in a plurality of sizes, one for each standard size of mattress or comforter to be produced. With such variety of clamps 50, clamp size can be changed to correspond to the adjustment of the adjustment mechanism 140 to accommodate different size quilts by moving the left side securement 40 in and out. Preferably, a minimum of standard sizes will be provided, for example, one for king-size panels, one for queen-size and double size panels, and one for full and twin size panels. Minor changes in size, such as between queen and double size and between full and twin size mattress covers or comforters, are preferably accommodated in plate 51 by providing for an adjustable connector 125 for the extensions 77 of the plate 51 of the clamp 50.

When the clamp 50 holding a panel along a leading edge thereof is so engaged with the belts 63 and 64 of the advancing drive mechanism 60, and the side securements 39 and 40 are in their clamping positions, actuation of the drive 68 in a direction to move the facing flights of the belts 63 and 64 in a downstream direction moves the leading edge clamp 50 downstream on the shuttle 20, pulling a panel between the upper and lower side securement assemblies 41 and 42 by which the belts 63 and 64 grip the side edges of the panel, as the panel is fed onto the shuttle 20. As this feeding action begins, the trailing edge clamp 46 is open, with the upper clamping bar 48 elevated to allow passage of the leading edge clamp 50 beneath it. When the leading edge clamp 50 passes the trailing edge clamp 46 and moves to the downstream side thereof, the trailing edge clamp is deactuated so that the bar 48 lowers onto the panel being pulled by the leading edge clamp 50, frictionally securing the panel between the bar 48 and the anvil 47. The trailing edge securement provided by the trailing edge clamp 46 and the clamping and pulling action of the leading edge clamp 50 on the leading edge of the panel applies longitudinal tension to the panel as it is fed onto and secured on the frame 21 of the shuttle 20.

On frame 11 of the machine 10 at the top thereof is an outfeed station 80 which includes a plurality of blanket or multiple belt conveyor tables, including a pair of outfeed tables 81 and 82. The first one of the outfeed tables 81 is positioned above and partially in back of the quilting station 17. The table 81 serves to receive quilted panels after they have been stitched at the quilting station 17. The table 81 has a lowered horizontal position, illustrated by solid lines in FIG. 1B, and a tilted or raised position, illustrated by the phantom lines in FIG. 1B, at which the front edge of the table 81 is pivoted upwardly by a piston cylinder 81*a* on each side thereof to position it into alignment with the second one of the tables 82. Quilted panels are deposited onto the table 81, preferably folded in half, with the table 81 in its lowered position, and then the table 81 is pivoted to its raised position for from which the quilted panel is advanced onto the table 82 by operation of the conveyors of both tables. On table 82, the quilted panel may be transported toward and past the front of the machine 10 over the head of an operator at the operator station 15, or the front of the table 82 may be lowered to present the quilted panel to the operator for further handling.

Transfer of a quilted panel from the shuttle 20 to the outfeed station 80 is provided by a transfer mechanism 84, which picks up the leading edge clamp 50 from the shuttle 20 and moves the clamp 50, with the leading edge of the quilted panel still clamped therein, to the outfeed station. This transfer permits the next panel to be quilted to be clamped to another leading edge clamp 50 and fed onto the shuttle 20 without delay of the operation of the machine 10. The transfer mechanism 84 includes, in the illustrated embodiment, a closed loop chain conveyor formed of a pair of chains 85, one mounted on each of the right and left side members 12 and 13 of the frame 11, and a clamp transfer head 86 that extends transversely across the frame 11 and is connected at each of its ends to each of the respective chains 85.

The chains 85 are driven by a motor 87 mounted on the frame 11. The output of the motor 87 is drivably linked to each of the chains through a common drive shaft 88 rotatably mounted on the machine frame 11 to extend transversely of the frame 11. The shaft 88 drives the chains 85 in synchronism through sprocket wheels 89 mounted to each of the ends of the shaft 88 at the sides of the frame 11. The chains 85 define a path that extends from a transfer station 90 adjacent the shuttle 20, generally above the shuttle upstream of the quilting station 17, to a quilt release position 91 above the table 81 at the outfeed station 80. Preferably, the path extends also from the quilt release position 91 to a clamp return position 92 at the front of the frame 11 of the machine 10 adjacent the operator station 15. A standby position 93 is also located along the path of the transfer mechanism at which the pickup head 86 rests waiting for a panel to be quilted at the quilting station 17.

Figure 6:
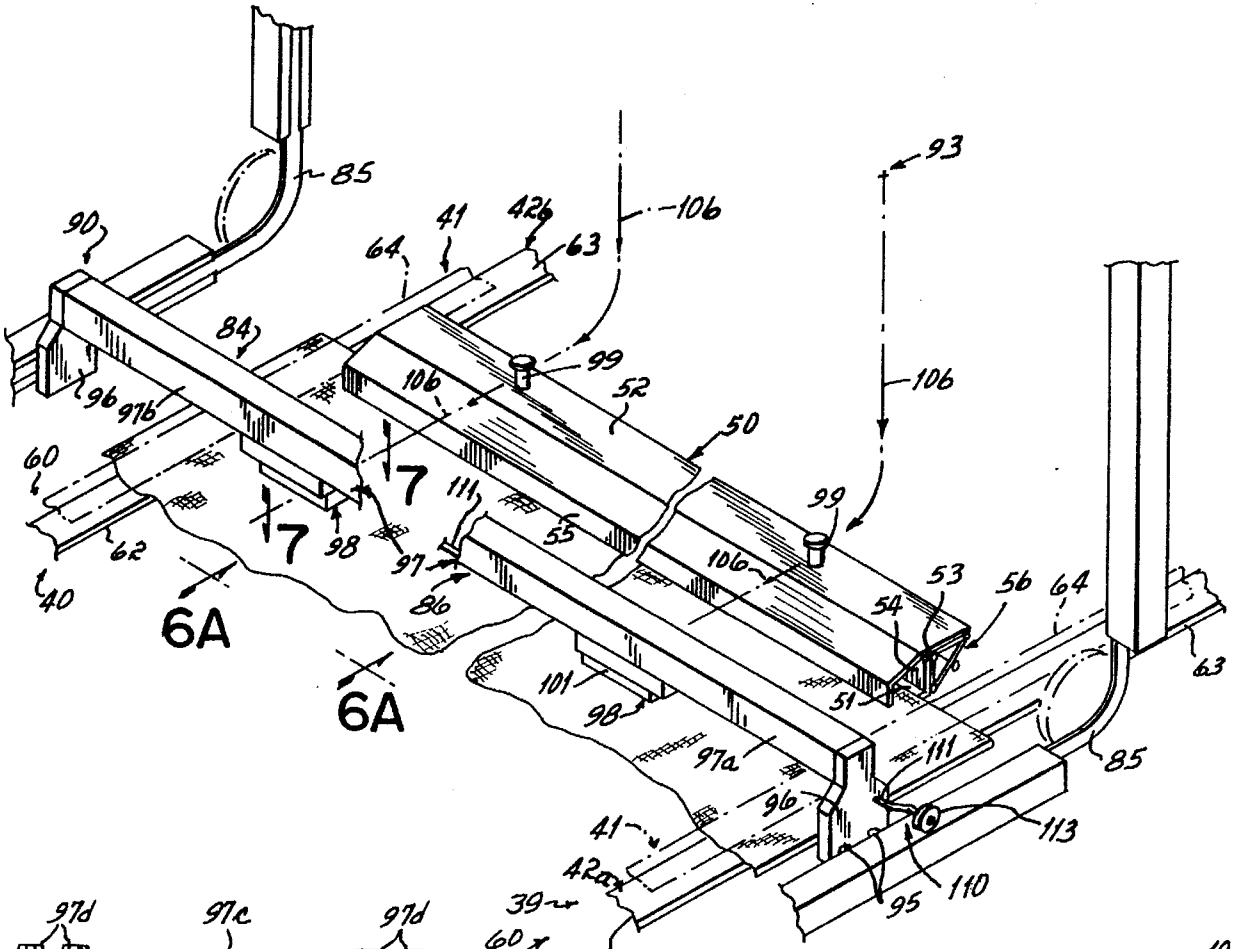
FIG. 6 is an isometric view similar to FIG. 5, partially broken away, but illustrating the downstream end of a shuttle with a leading edge clamp and clamp pickup head in a transfer position.

FIG. 6 illustrates the pickup head 86 at the transfer station 90. The pickup head 86 is mounted to each of the chains 85 by two pins 95 carried by a pair of end flanges 96, and is thereby supported in a constant orientation relative to the orientation of the chain 85 at the points to which the pins 95 are connected. The pickup head 86 includes a transverse bar 97 fixed at its ends to the end flanges 96 and a pair of latches 98 mounted on one side of the bar 97, which is the bottom side of the bar 97 when the pickup head is oriented as illustrated in FIG. 6 and is at the transfer station 90. The latches 98 are similar to commercially available automobile door latches, which each lock onto and release from a latch post 99 on the top of the leading edge clamps 50.

Figure 7:
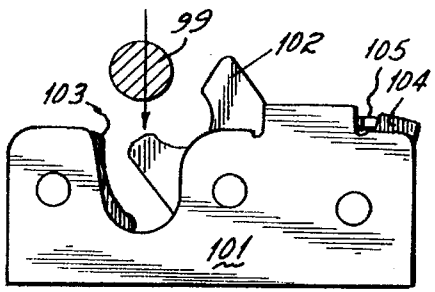
FIG. 7 is a cross-sectional view, taken along the line 7—7 of FIG. 6, of pickup latch of the pickup head and leading edge clamp, illustrating the latch in an open condition.
Figure 7A:
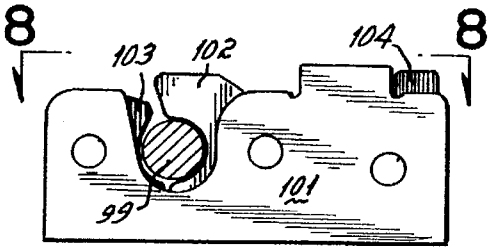
FIG. 7A is a cross-sectional view similar to FIG. 7 but illustrating the latch in a closed condition.
Figure 8:
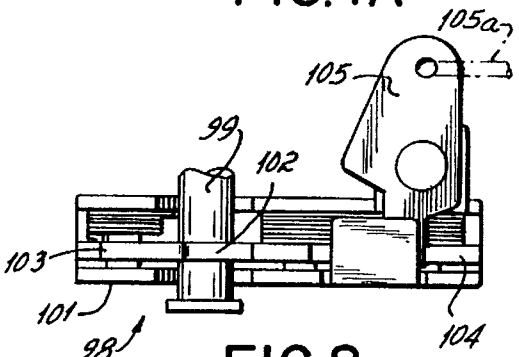
FIG. 8, is view of the latch of FIG. 7A taken along the line 8—8 of FIG. 7A.

The latches are illustrated in detail in FIG. 7, FIG. 7A and FIG. 8. In FIG. 7, the latch 98 is illustrated in a released condition. Each latch 98 includes a housing 101 in which are pivotally connected three spring biased latching elements 102, 103 and 104. The elements 102 remain pivoted outwardly as shown in FIG. 7 until engaged by the latch post 99 moving against it, whereupon they cam against the element 103 and latch closed around the post 99, as illustrated in FIG. 7A and FIG. 8. Each latch is also provided with a release lever 105 which are interconnected by a release lever connector link 105*a*. From the latched position, movement of the elements 104, which function as release levers for the latches 98, causes the elements 102 and 103 to return to the positions of FIG. 7A, thereby releasing the post 99. Releasing of the latches 98 may be carried out by operator actuation at the operator station 15 of the levers 105, or preferably by automatic camming, cylinder or solenoid operation of the lever 105, in response to the motion of the pickup head 86 to the clamp return position 92 or to a signal from the machine controller.

Figure 6A:
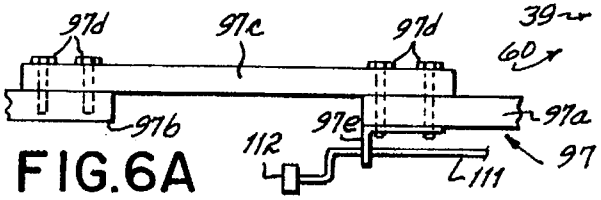
FIG. 6A is a fragmentary elevational view taken along the line 6A—6A of FIG. 6 illustrating of a portion of the clamp pickup head.
Figure 6C:
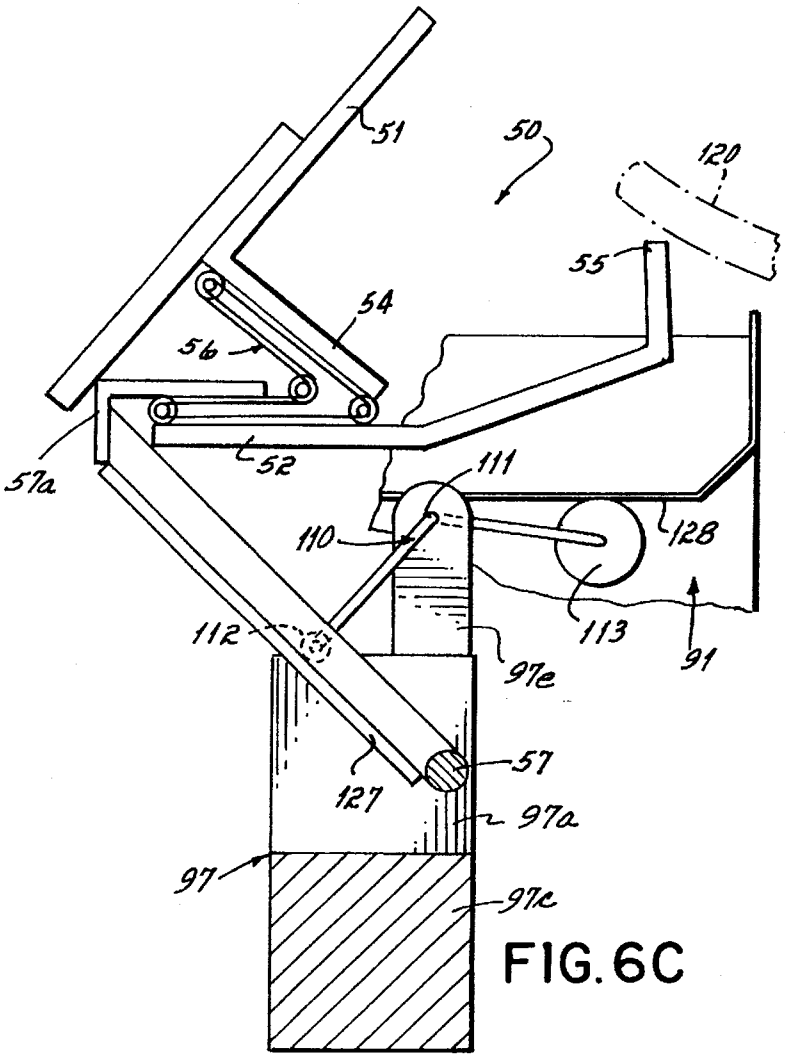
FIG. 6C is an enlarged side view similar to FIG. 6B of the clamp pickup head and leading edge clamp in a unclamped condition at the quilt release position for releasing a quilted panel onto the outfeed table at the outfeed station.

The pickup head 86 has mounted thereon a camming lever mechanism 110 that serves to form a quilt release lever link between the release plate 127 (FIG. 5) on the handle 57 of the clamps 50 and the camming plate or shoe 128 (FIG. 1B) at the quilt release position 91. As illustrated in FIG. 6–6C, the mechanism 110 includes a lever shaft 111 pivotally mounted on the pickup head 86. The bar 97 of the pickup head 86 is formed of a pair of aligned end sections 97*a* and 97*b* and an offset center section 97*c*, secured at its ends by bolts 97*d* to the end sections 97*a* and 97*b*, as illustrated in FIG. 6A. The three sections 97*a*, 97*b*, 97*c* of the bar 97 provide clearance for the handle 57 of the leading edge clamp 50 so that the clamp 50 can be opened to release a quilted panel while the clamp 50 is being supported by the pickup head 86. Referring to FIGS. 6 and 6A, the lever shaft 111 is pivotally mounted to the head 86 by being supported at one end in a hole in the right one of the end flanges 96 and at the other end in a hole in a bracket 97*e* supported on the bottom of the right end section 97*b* of the bar 97 by two of the bolts 97*d*.

Figure 6B:
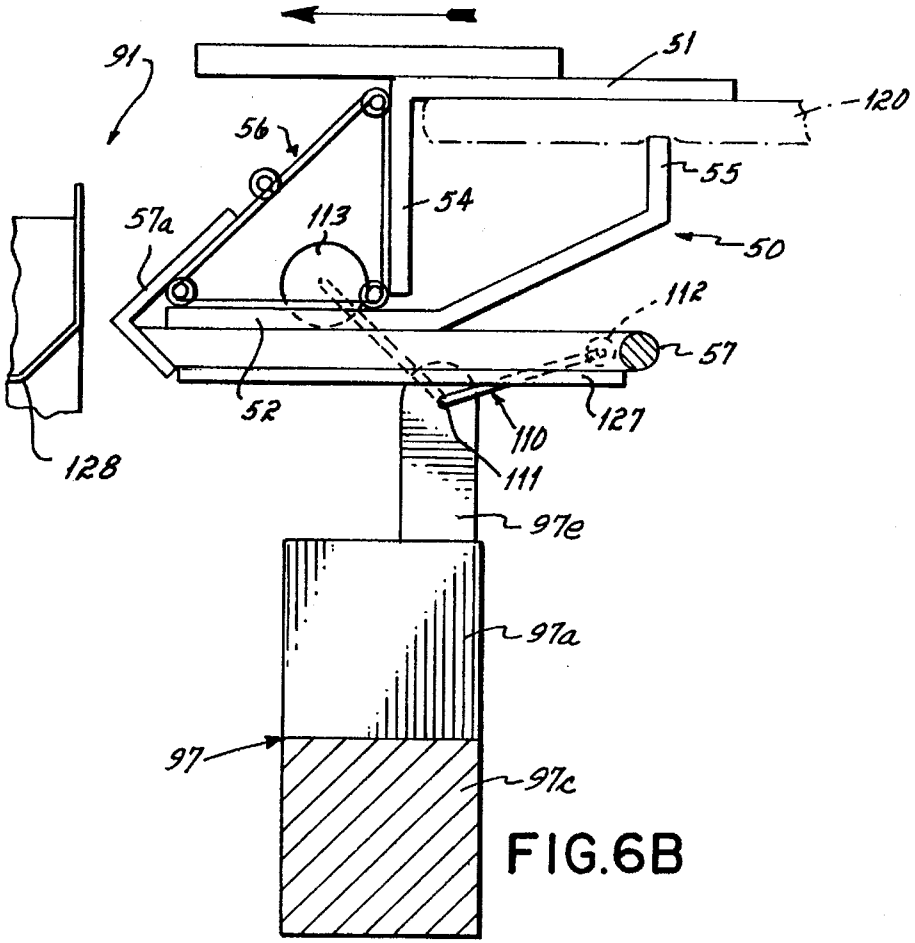
FIG. 6B is an enlarged side view of the clamp pickup head of FIG. 6 and of the leading edge clamp in a clamped condition while approaching the quilt release position adjacent the outfeed station.

The ends of the shaft 111 are bent at right angles to the bar 97, and at an angle relative to each other. At the tips of each of the inner and outer bent ends of the shaft 111 is pivotally mounted camming wheels 112 and 113, respectively. When a clamp 50 is carried by the pickup head 86, the inner wheel 112 lies against the plate 127 between the plate 127 and the clamp head 51. The outermost wheel 113 is free. When the pickup head 86 passes the quilt release position 91, the pickup head 86 and clamp 50 will have inverted and are moving toward the front of the machine 10, and the various parts of the release mechanism 110 come together as schematically illustrated in FIG. 6B. As shown in FIG. 6B, at the quilt release position 91, the outer free wheel 113 approaches shoe 128, which is fixed to the side 12 of frame 11 at the quilt release position 91 adjacent the path of the head 86, and is cammed so as to rotate the shaft 111 around and below the shoe 128 to move the inner wheel 112 downward against the plate 127, thereby rotating the handle 57 and the handle bracket 57*a* causing the over center latching mechanism to release, allowing the clamp head 52 to drop away from the clamp plate 51, causing the clamp 50 to release, dropping quilted panel 120 being carried thereby.

The cycle of operation of the transfer mechanism 84 begins with the pickup head 86 in the standby position 93 (FIGS. 1A, 1B). After a panel has been quilted at the quilting station 17, the shuttle 20 is shifted upstream, toward the operator end of the machine, to place the rear securement 46 on the upstream or operator side of the transfer station 90, while the leading edge clamp 50 remains downstream of the transfer station 90. With the shuttle 20 in this position, the chain 85 is driven so as to carry the pickup head 86 from the standby position 93 to the transfer position 90, moving in the direction of the arrows 106 in FIG. 6. Then, the shuttle 20 continues its movement longitudinally upstream, toward the front of the machine, bringing the leading edge clamp 50 to the transfer station 90 and latching posts 99 thereon into latching engagement with the latches 98 of the pickup head 86, causing the latches 98 to latch, as in FIGS. 7A and 8, whereby the clamp 50 becomes securely locked to the pickup head 86. Thereupon, the side securements 39 and 40 and the trailing edge securement 46 are released to release the quilted panel from the shuttle 20, whereupon the chain 85 is driven to carry the pickup head 86 and clamp 50 up and over the table 81. Preferably, the pickup head 86 is carried to the back of the table 81, around end sprocket 108 that supports the chain 85 at the back of the table 81, and forward to the front of the table 81, where preferably is located the quilt release station or position 91, thereby folding the quilted panel in half. At the release position 91 (see FIG. 6B and 6C) is located stationary cam or shoe 128 of the quilt release mechanism 110, fixed to the frame 11 at the release position 91, to trip the handle 57 and release the leading edge clamp 50, causing the clamp to drop the quilted panel on the table 81 in folded condition. Then the chain 85 is further driven to bring the pickup head 86 and the clamp 50, but not the quilted panel, to the clamp return position 92.

Figure 6F:
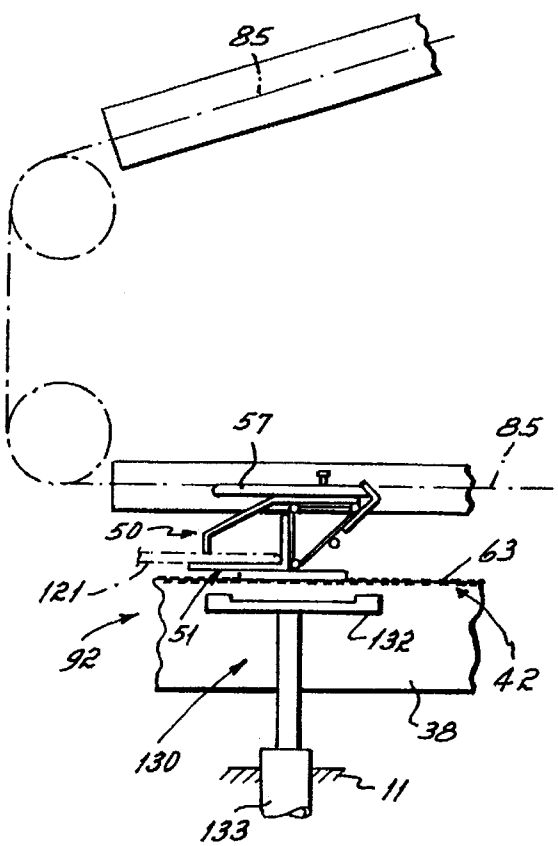
FIG. 6F is an enlarged side view similar to FIG. 6E, but showing the clamp receiving platform placing the returned leading edge clamp onto the leading edge of the shuttle.
Figure 6E:
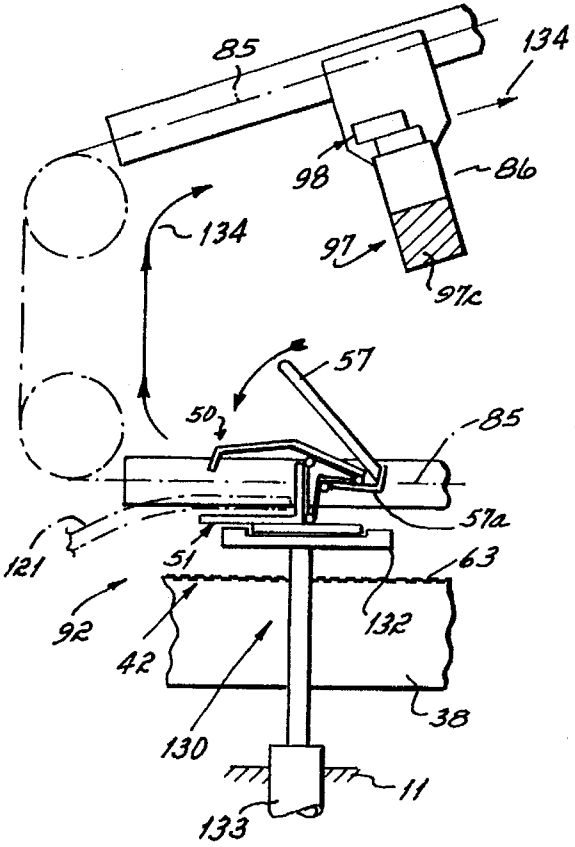
FIG. 6E is an enlarged side view similar to FIG. 6D of the clamp pickup head at the return station illustrating a fabric panel being loaded therein by an operator.
Figure 6D:
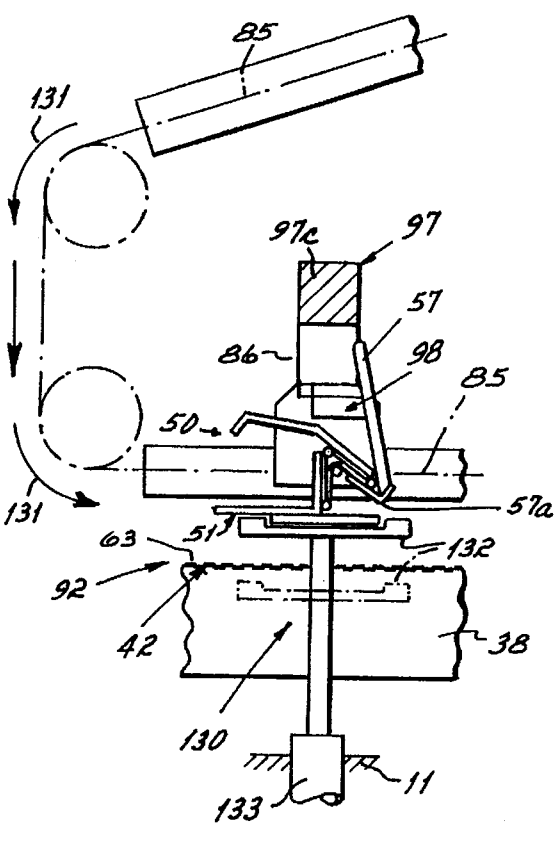
FIG. 6D is an enlarged side view of the clamp pickup head returning a leading edge clamp to the return station at the operator station.

The clamp 50 is removed from the pickup head 86 at the clamp return position 92, preferably automatically by a pickup head release assembly 130, illustrated in FIGS. 6D–6F. Referring to FIG. 6D, the pickup head 86 is shown after being moved to the clamp return position 92 by movement of the chain conveyor 85 in the direction illustrated by the arrows 131. When the presence of the pickup head 86, which is carrying a clamp 50, is detected at the clamp release position 92 by a detector (not shown), such as a limit switch, photoelectric detector, magnetic detector, or chain position monitoring logic in the machine controller, a clamp return platform 132 is raised by the actuation of a platform lift cylinder 133 fixed to the frame 11, which moves the platform 132 from the phantom position into a position, shown in solid lines, against the bottom of the clamp plate 51 to support the clamp 50 on the platform 132. Thereupon, a latch trip cylinder (not shown) is actuated to trip the latch release lever link 105*a* (previously described) to cause the latches 98 to release the clamp 50 onto the platform 132 or the operator may manually activate the link 105*a* to release the clamp 50.

When the clamp 50 is released onto the platform 132, the chain 85 is driven to return the pickup head 86 to its standby position 93, either by moving chain in the same direction to carry the pickup head 86 over the area occupied by the shuttle 20 in FIG. 1A, or by reversing the chain 85 to return the pickup head 86 back over through the outfeed station 80, along a path illustrated by the arrows 134 in FIG. 6E. Preferably, the pickup head 86 is returned over the outfeed station 80, where it be moved immediately, rather than over the lower course of the chain 85 which requires awaiting the movement of the shuttle 20 downstream through the quilting station 17 and out of the path that the pickup head 86 would travel. While the clamp 50 is supported on the platform 132 and the shuttle 20 may be otherwise in use, the operator may insert a next comforter panel in the clamp 50. Then, when the shuttle 20 is returned to its position toward the front of the frame 11 adjacent the operator station 15, the cylinder 133 is deactivated, lowering the clamp 50 onto the upstream ends of the shuttle 20 and the lower belts 63, as illustrated in FIG. 6F, which is a position just upstream of that illustrated in FIG. 5.

Figure 9A:
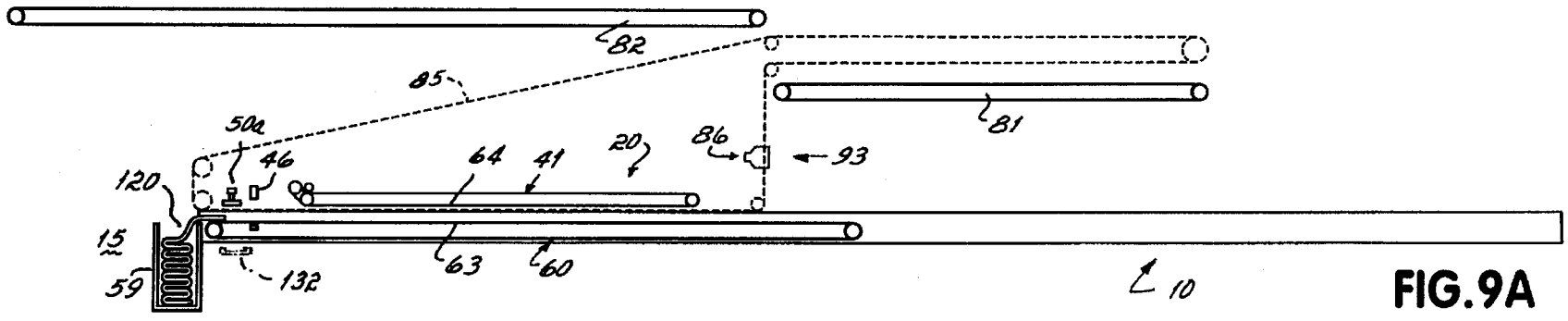
FIGS. 9A–9H are a series of diagrams illustrating one embodiment of a quilting method according to the present invention.

The preferred sequence of use and operation of the machine 10 is illustrated in the sequence of diagrams of FIGS. 9A–9H. In FIG. 9A, the machine 10 is illustrated in its initial configuration prior to the feeding of the first of a series of panels 120 into the machine 10 for quilting. The first panel is shown in the trough 59, having been so placed by an operator at the operator station 15. At this position, the operator places the leading edge of the panel 120 into the first of a plurality of leading edge clamps 50*a*. At this point in the process, the shuttle 20 is shifted longitudinally toward the front of the machine 10, which is the home position to which it is brought by the machine controller. In this position, the upper side securements 41 on the shuttle and the trailing edge clamp 46 are raised to their release positions by actuation of respective actuators under the control of the machine controller. Further at this point in the process, the pickup head 86 of the transfer mechanism 84 is in its standby position 93, and the first table 81 of the outfeed station 80 is in its lowered position.

Figure 9B:
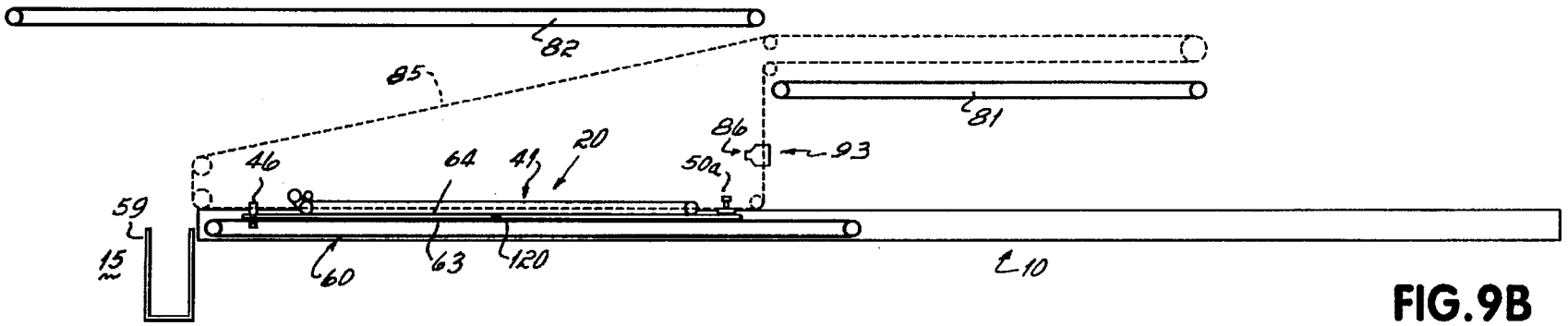
Figure 9C:
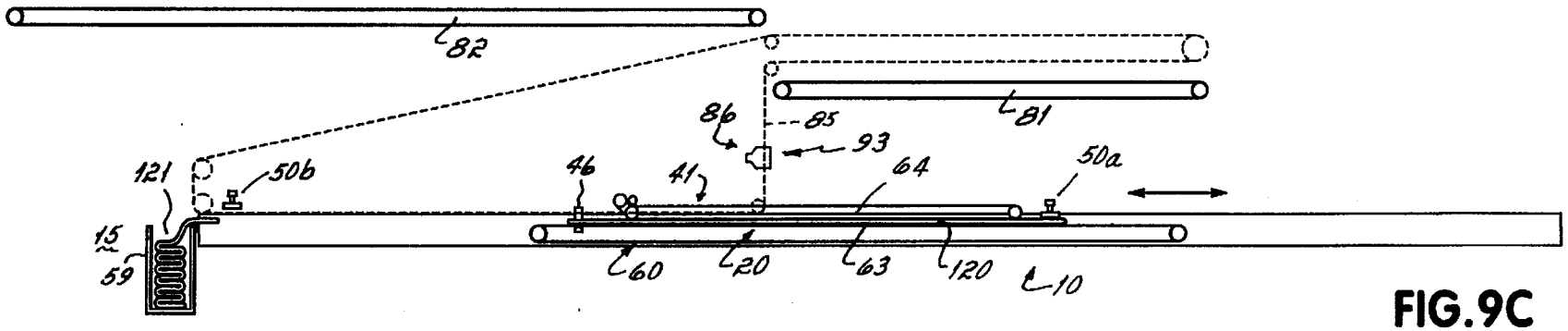

Next, the platform 132 is lowered to place the clamp 50*a* onto lower belts 63 with the notches 76 in extensions 77 in engagement with the lugs 78 of the belts 63. When the operator actuates a control on the control panel 16, the infeeding of the panel 120 is initiated by which trailing edge clamp 46 is raised and the clamp 50*a* is fed into the mouth of the advancing mechanism 60, between the upper and lower belts 64 and 63 of the belt conveyors 61 and 62. This action energizes the motor 68 to drive the lower belts 63, and causes the upper belts 64 (and upper side securements 41) to be lowered, thereby engaging the clamp 50*a* and advancing the clamp 50*a* and the panel 120 to the positions illustrated in FIG. 9B. Then, the entire shuttle 20 is moved, by energization of the motor 31, to beneath the sewing head 18 at the quilting station 17, where a pattern is stitched onto the panel 120, as illustrated in FIG. 9C. In the meantime, the operator at the operator station 15 has placed the next panel 121 to be quilted in a second leading edge clamp 50*b*, which then awaits the availability of the shuttle 20.

Figure 9D:
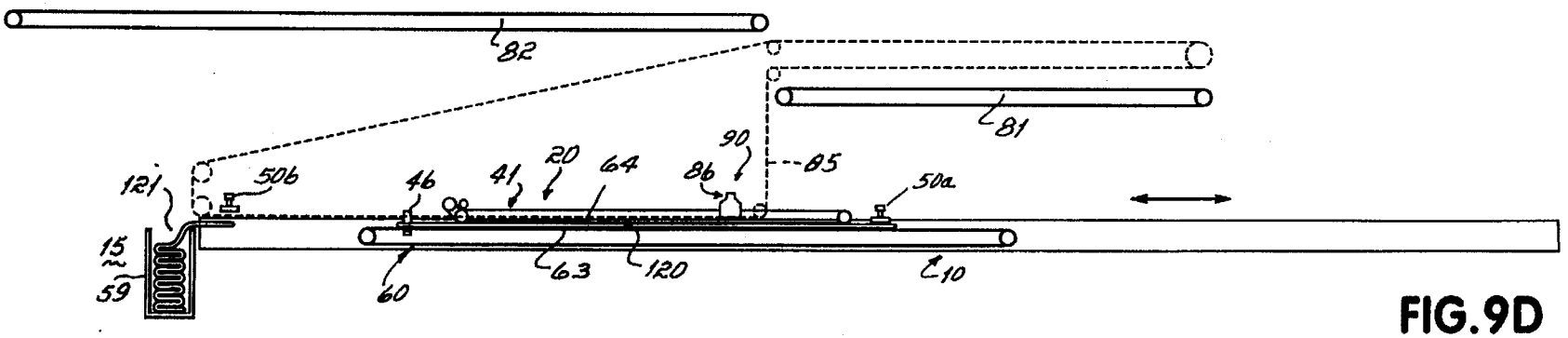
Figure 9E:
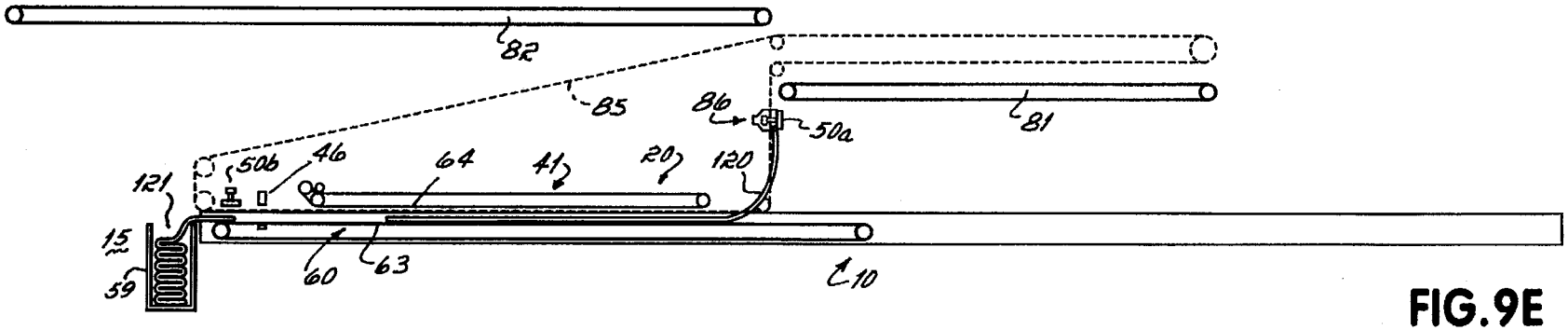

When panel 120 has been stitched at the quilting station 17, the shuttle 20 is shifted longitudinally toward the front of the machine 10, and as the trailing edge clamp 46 passes the transfer station 90, the transfer mechanism 84 is actuated to bring the pickup head 86 down from its standby position 93 to the transfer position 90, as illustrated in FIG. 9D. Then, when the leading edge clamp 50*a* reaches the transfer position 90, the pickup head 86 is latched downstream with the clamp 50*a*, whereupon the side securements 39 and 40 and the trailing edge securement 46 on the shuttle 20 are released, and the transfer mechanism 84 continues to carry the pickup head 86 downstream and then upward along the chain 85 to carry the clamp 50*a* along with the quilted panel 120 toward the outfeed station 80, as illustrated in FIG. 9E.

Figure 9F:
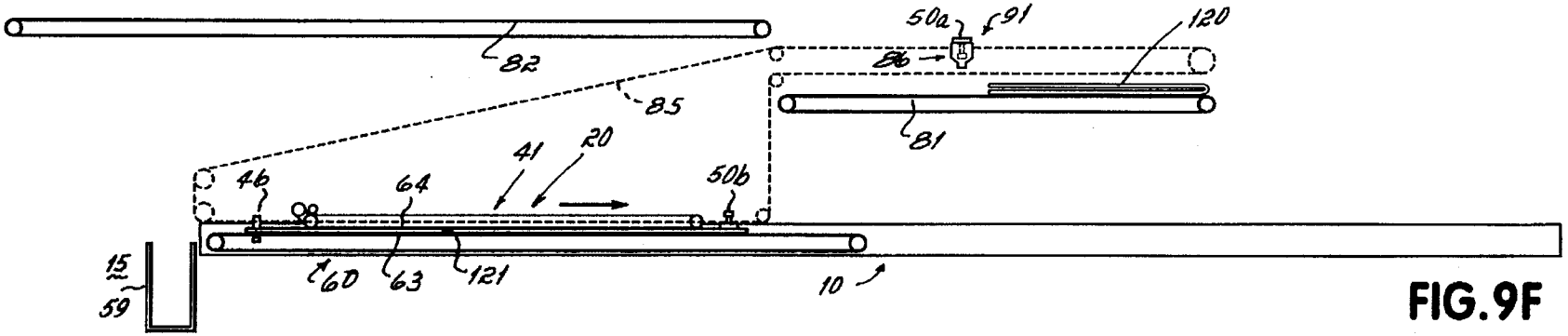
Figure 9G:
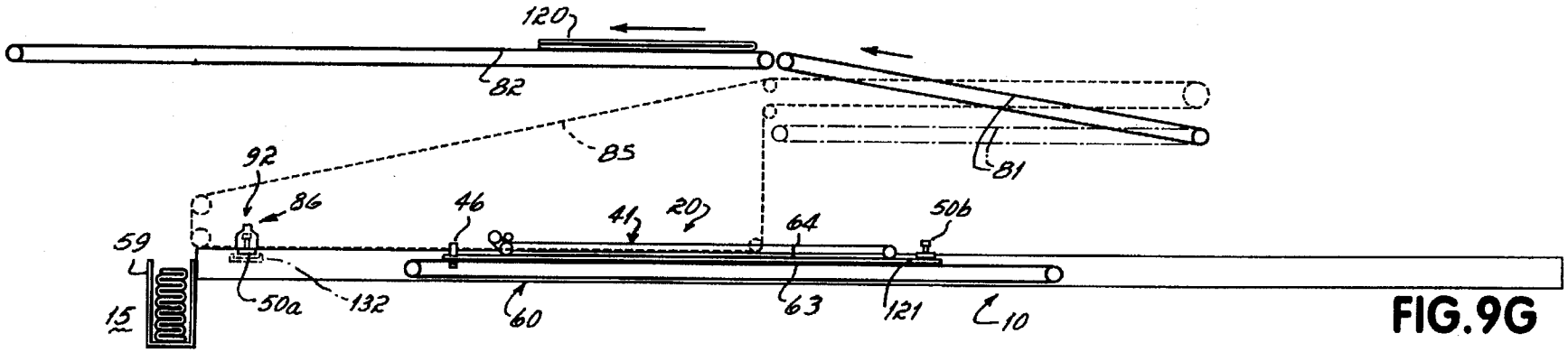

When the trailing edge of the panel 120 is clear of the shuttle 20, the next leading edge clamp 50*b*, along with the next panel 121 to be quilted, is fed onto the shuttle 20, as illustrated in FIG. 9F, in a manner similar to that described in connection with FIG. 9B. Simultaneously, the transfer mechanism 84 moves the pickup head 86 past the quilt release station 91 over the outfeed table 81 at the outfeed station 80 and releases the panel 120 onto the table 81, also as illustrated in FIG. 9F. Then, the transfer mechanism 84 continues to move the pickup head 86, which is carries clamp 50*a*, to the clamp return position 92 at the operator station 15, where the clamp 50*a* is released onto the platform 132 where it can be reused by the operator, as illustrated in FIG. 9G, while the table 81 is elevated by a piston and cylinder 81*a* and driven by a motor (not shown) to convey the folded quilted panel 120 to the table 82.

Figure 9H:
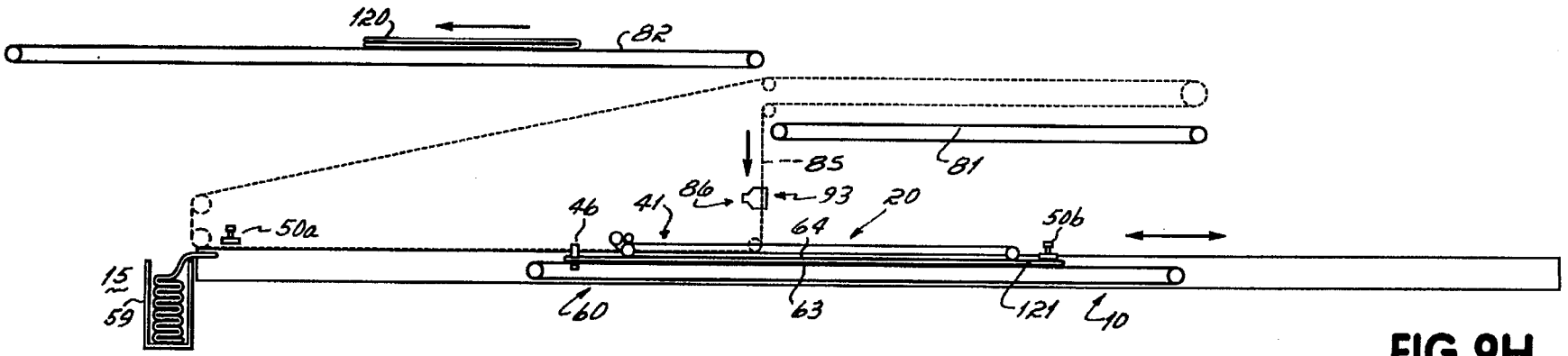

The shuttle 20 then moves through the quilting station 17 with the panel 121 where the quilting head 18 proceeds to quilt a pattern on the panel 121, and the transfer mechanism 84 actuates to carry the pickup head 86 back to its standby position 93, as illustrated in FIG. 9H, which is similar to the position of FIG. 9C. Preferably, the pickup head 86 is returned to its standby position 93 by reversing the chain 85 and carrying the pickup head 86 back over the table 81, after the table 81 has been brought down to its lowered position. While the pickup head 86 is being returned to the standby position 93, the quilted panel 120 at the outfeed station 80 may be in the process of being transported on the table 82 to a stacking station (not shown).

From the above description of the preferred embodiments of the invention, it will be apparent to those skilled in the art that changes and additions to the method and apparatus can be made without departing from the principles of the present invention.

Accordingly, the following is claimed:

1. A method of quilting rectangular panels of fabric comprising the steps of:

providing a leading edge clamp and a shuttle longitudinally moveable on a stationary frame past a transversely moveable quilting head, the shuttle comprising two side edge securements and a trailing edge securement; then connecting the leading edge clamp to a leading edge of a rectangular panel of fabric; then moving the leading edge clamp and the leading edge of the panel relative to the shuttle to position the panel of fabric on the shuttle and engaging three edges of the panel with the two side edge securements and the trailing edge securement of the shuttle to thereby support the panel along four edges thereof wherein support of the fourth edge is provided by the leading edge clamp; then moving the leading edge clamp and the shuttle longitudinally on the frame and moving the quilting head transversely on the frame while stitching a pattern on the panel of fabric; and then releasing the panel of fabric from the securements and moving the leading edge clamp away from the shuttle while carrying the panel of fabric therewith to an outfeed station.

2. The method of claim 1 further comprising the steps of:

providing a second leading edge clamp; then connecting the second leading edge clamp to a leading edge of a second rectangular panel of fabric; then after the releasing step, moving the second leading edge clamp and the leading edge of the second panel relative to the shuttle to position the second panel of fabric on the shuttle and engaging three edges of the second panel with the two side edge securements and the trailing edge securement of the shuttle to thereby support the second panel along four edges thereof; then moving the second leading edge clamp and the shuttle longitudinally on the frame and moving the quilting head transversely on the frame while stitching a pattern on the panel of fabric.

3. The method of claim 2 further comprising the steps of:

disconnecting the first recited panel of fabric from the first recited leading edge clamp and thereby depositing the first panel of fabric at the outfeed station; then releasing the second panel of fabric from the securements and moving the second front edge clamp away from the shuttle while carrying the second panel of fabric therewith to the outfeed station.

4. The method of claim 3 further comprising the steps of:

removing the first recited panel from the outfeed station; then disconnecting the second panel of fabric from the second leading edge clamp and thereby depositing the second panel of fabric at the outfeed station.

5. The method of claim 3 further comprising the steps of:

providing a clamp pickup mechanism;

performing the step of moving the first recited leading edge clamp away from the shuttle by engaging the clamp from the shuttle and moving the mechanism to the outfeed station; then after disconnecting the first recited panel of fabric from the first recited leading edge clamp, disengaging the clamp; then moving the mechanism to the shuttle and performing the step of moving the second leading edge clamp away from the shuttle by engaging the second leading edge clamp from the shuttle and moving the mechanism to the outfeed station.

6. The method of claim 5 further comprising the steps of:

providing an operator station;

performing the connecting steps at the operator station; and after each disconnecting step, moving the mechanism to the operator station and performing the disengaging step at the operator station.

7. The method of claim 1 wherein:

the trailing edge securement is a transversely extending member; and the step of engaging an edge of a panel of fabric with the trailing edge securement includes the step of moving the member against the panel of fabric to apply longitudinal tension to the panel of fabric upon the panel of fabric being moved relative to the shuttle.

8. The method of claim 1 wherein:

the side edge securements each comprise an opposed belt conveyor;

the step of engaging an edge of a panel of fabric with a side edge securements includes the step of feeding side edges of the panel between opposed belts of the conveyors.

9. The method of claim 8 wherein:

the step of moving the leading edge clamp relative to the shuttle includes the step of connecting the leading edge clamp at opposite ends thereof to each of the conveyors and driving the conveyors to move the clamp relative to the shuttle.

10. The method of claim 8 further comprising the step of:

applying transverse tension to the panel with the side edge securements.

11. A quilting apparatus for quilting a rectangular panel of multilayered fabric comprising:

a main machine frame having a front and a back at opposite longitudinal ends thereof and two sides at opposite transverse ends thereof;

an operator station generally near the front of the frame;

a quilting station generally intermediate the front and back;

a sewing head transversely movably mounted to the frame at the quilting station;

a panel shuttle mounted on the frame and moveable longitudinally along a path to and from the operator station and at least partially through the quilting station;

two longitudinally extending side securements and a trailing edge securement mounted on the shuttle;

an outfeed station on the frame;

a leading edge clamp removably connectable to the shuttle from the operator station and moveable on the shuttle along the path; and a clamp transfer mechanism mounted on the frame and moveable between a transfer position adjacent the path and the outfeed station, the leading edge clamp being removably connectable to the transfer mechanism from the transfer position.

12. The quilting apparatus of claim 11 wherein:

the shuttle is rectangular and is mounted in a horizontal plane on the frame and moveable longitudinally through the quilting station, and has an upstream end toward the front of the frame, a downstream end toward the back of the frame and two opposite sides near the sides of the frame;

the side securements each include a longitudinally extending opposed belt conveyor at the sides of the shuttle and the trailing edge securement includes a transversely extending trailing edge clamp at the upstream end of the shuttle;

the leading edge clamp is removeably connectable at opposite ends thereof to each of the two belt conveyors.

13. The quilting apparatus of claim 11 wherein:

the outfeed station includes a receiving table at the top of the frame, the table including means for moving panels placed thereon to a stacking location.

14. The quilting apparatus of claim 11 wherein:

the clamp transfer mechanism includes means for picking up the clamp from the shuttle and moving the clamp, along with a quilted panel carried thereby, to the outfeed station.

15. The quilting apparatus of claim 11 wherein:

the clamp transfer mechanism includes means for moving a clamp from the outfeed station to the operator station.

16. The quilting apparatus of claim 11 further comprising:

at least one additional leading edge clamp at the operator station while the first recited leading edge clamp connected to the transfer mechanism.

17. A quilting apparatus comprising:

a stationary frame;

an operator station at the front of the frame;

a quilting station on the frame having a sewing head transversely moveable thereon;

a rectangular shuttle having means thereon for supporting a rectangular panel of multilayered fabric in a horizontal plane thereon for quilting, the panel supporting means including means for holding the panel along each of four edges thereof to maintain transverse and longitudinal tension on the panel;

means for longitudinally moving the shuttle on the frame to and from the operator station and through the quilting station;

means for moving the sewing head transversely on the frame;

programmed control means for operating the shuttle moving means, the sewing head moving means and the sewing head to stitch a quilt pattern on the panel supported on the shuttle;

a plurality of leading edge clamps each independently removably connectable to the shuttle so that one clamp of the plurality can form part of the holding means by securing a panel along one edge thereto;

means for advancing the one clamp, when connected to the shuttle, and a panel secured thereto, to a position on the shuttle where the panel is held by the holding means;

an outfeed station on the frame; and means for transferring the one clamp, and the panel secured thereto, from the shuttle to the outfeed station.

18. The quilting apparatus of claim 17 further comprising:

two longitudinally extending opposed belt conveyors on the shuttle, each on one side thereof, the conveyors being included in both the holding means and the advancing means for performing at least part of the functions thereof, and a transversely extending trailing edge clamp on the shuttle, being included in the holding means for performing at least part of the function thereof.

19. The quilting apparatus of claim 17 wherein the clamp transferring means includes:

means for causing the panel to be released at the outfeed station; and means for moving a clamp the outfeed station to the operator station.

20. The quilting apparatus of claim 19 wherein the transferring means comprises:

a transfer conveyor mounted on the frame and extending along at least part of the path, to adjacent the outfeed station, and to the operator station, and a clamp pickup head moveable on the chain conveyor.

21. The quilting apparatus of claim 20 further comprising:

a machine control including means responsive in part to input from an operator at the operator station and in part from a program executed by a processor for controlling the apparatus to perform the steps of:

(1) engaging a leading edge of a first panel with a first leading edge clamp and performing the sub-steps of:

(a) carrying the leading edge clamp with the belt conveyors toward the leading edge of the shuttle and thereby pulling the panel onto the shuttle and gripping the sheet at side edges thereof by the belt conveyors, then gripping the trailing edge of the panel with the trailing edge clamp, (b) enabling the moving the shuttle longitudinally through the quilting station and moving the sewing head transversely on the frame to stitch a pattern on the panel; then (c) moving the shuttle and the transfer conveyor to bring the leading edge clamp and the clamp pickup head together and engaging the leading edge clamp with the clamp pickup head; then (d) moving the clamp pickup head with the chain conveyor to the outfeed station, with the leading edge of the sheet gripped by the leading edge clamp engaged by the head, to pull the sheet to the table;

then (2) engaging a leading edge of a second panel with a second leading edge clamp and performing sub-steps (a) through (d) therewith while, with the first leading edge clamp and panel:

(e) releasing the panel from the leading edge clamp to place the panel at the outfeed station; then (f) moving the clamp pickup head on the transfer conveyor to the operator station; then (g) releasing the leading edge clamp from the clamp pickup head at the operator station;

then (3) engaging a leading edge of a third panel with either the first or a third leading edge clamp and performing sub-steps (a) through (d) therewith while, with the second leading edge clamp and second panel, performing steps (e) through (g).

22. A method of quilting rectangular panels of fabric comprising the steps of:

providing a quilting head, a leading edge clamp and a shuttle on a stationary frame, the shuttle and clamp being moveable relative to the quilting head, the shuttle having two side edge securements and a trailing edge securement; then connecting the leading edge clamp to a leading edge of a rectangular panel of fabric; then moving the leading edge clamp and the leading edge of the panel relative to the shuttle to position the panel of fabric on the shuttle and engaging three edges of the panel with the two side edge securements and the trailing edge securement to support the panel along four edges thereof on the shuttle; then moving the leading edge clamp and the shuttle relative to the quilting head on the frame while stitching a pattern on the panel of fabric; and then releasing the panel of fabric from the securements and moving the leading edge clamp away from the shuttle while carrying the panel of fabric therewith to an outfeed station.

* * * * *

UNITED STATES PATENT AND TRADEMARK OFFICE

CERTIFICATE OF CORRECTION

PATENT NO. : 5,640,916

DATED : June 24, 1997

INVENTOR(S) : Jeff Kaetterhenry, Glenn E. Leavis, James T. Frazer, David B. Scott, Andrew K. Schnaufer It is certified that error appears in the above-indentified patent and that said Letters Patent is hereby corrected as shown below:

In claim 12, column 15, line 48, delete "removeably" and insert "removably".

In claim 16, column 15, line 65, insert "is" after "clamp".

In claim 19, column 16, line 46, insert "from" after "clamp".

In claim 21, column 17, line 1, insert "of" after "moving".

Signed and Sealed this

Twenty-third Day of June, 1998

Bruce Lehman

*Attest:*

BRUCE LEHMAN

*Attesting Officer*

*Commissioner of Patents and Trademarks*